US005493961A

United States Patent [19]

Gerhardt et al.

[11] Patent Number: 5,493,961

[45] Date of Patent: Feb. 27, 1996

[54] CONTINUOUS BOARD-MAKING PRESS INCLUDING PRESS PLATE DEFORMATION SAFETY DEVICE

[75] Inventors: Klaus Gerhardt, Rheurdt; Lothar Sebastian, Bochum, both of Germany

[73] Assignee: G. Siempelkamp GmbH & Co., Krefeld, Germany

[21] Appl. No.: 353,019

[22] Filed: Dec. 9, 1994

[30] Foreign Application Priority Data

Dec. 11, 1993 [DE] Germany ..... 4342279.9

[51] Int. Cl.[6] ..... B30B 5/06; B30B 15/16

[52] U.S. Cl. ..... 100/50; 100/53; 100/99; 100/151; 425/136; 425/141; 425/149; 425/154; 425/371

[58] Field of Search ..... 100/41, 43, 48, 100/50, 52, 53, 99, 151, 154; 425/136, 141, 149, 150, 151, 154, 371

[56] References Cited

U.S. PATENT DOCUMENTS

| | | | |
|---|---|---|---|
| 3,545,370 | 12/1970 | Caughey | 100/144 |
| 3,881,852 | 5/1975 | Ahrweiler | 100/53 |
| 3,907,473 | 9/1975 | de Mets | 100/151 |
| 4,002,114 | 1/1977 | Guttinger | 425/136 |
| 4,017,235 | 4/1977 | Ahrweiler | 100/154 |
| 4,029,456 | 6/1977 | Ahrweiler | 100/154 |
| 4,265,608 | 5/1981 | Tunador et al. | 425/149 |
| 4,645,632 | 2/1987 | Böttger et al. | 100/154 |
| 5,112,431 | 5/1992 | Gerhardt et al. | 156/583.5 |

FOREIGN PATENT DOCUMENTS

| | | | |
|---|---|---|---|
| 2451894 | 5/1976 | Germany . | |
| 4123517 | 9/1992 | Germany | 100/99 |

*Primary Examiner*—Stephen F. Gerrity
*Attorney, Agent, or Firm*—Herbert Dubno; Andrew Wilford

[57] ABSTRACT

A press for making pressed board has a plurality of longitudinally spaced rigid frames, a lower press plate extending longitudinally through and secured to the frames, and a normally planar upper press plate extending longitudinally above the lower plate through the frames and defining with the lower press plate a longitudinally throughgoing press gap. A plurality of vertically effective double-acting hydraulic cylinders carried on the frames above the upper plate each have a back compartment and a front compartment, are connected to the upper plate, and support the upper plate on the frames. Respective upper and lower endless belts have respective lower and upper stretches extending through the gap immediately below and above the respective upper and lower plates and respective upper and lower rollers advance the stretches longitudinally through the frames. Sensors connected to the lower plate produce an output corresponding to the size of the gap. A safety unit connected to the upper plate produces an output when the upper plate is deformed to a predetermined extent from a planar shape. A hydraulic valve system connected to the compartments of the double-acting cylinders pressurizes and depressurizes same. A controller connected to the safety unit and valve system pressurizes the front compartments of the cylinders when the safety unit generates its output and thereby hydraulically blocks downward movement of the upper plate.

10 Claims, 6 Drawing Sheets

CONTINUOUS BOARD-MAKING PRESS INCLUDING PRESS PLATE DEFORMATION SAFETY DEVICE

FIELD OF THE INVENTION

The present invention relates to a press. More particularly this invention concerns a press for the continuous manufacture of pressed board, which term here includes fiberboard, plywood, chipboard, and the like.

BACKGROUND OF THE INVENTION

A standard press of the type used in the continuous production of fiberboard, particleboard, and the like has a rigid press frame having vertically spaced upper and lower parts defining a press gap. Upper and lower belts are spanned in the respective press parts between respective upstream and downstream rollers, at least one of which is driven to advance confronting upper and lower stretches of the lower and upper belts longitudinally through the press. Upper and lower press plates bear, typically by some sort of roller arrangement, on the lower and upper surfaces of the upper and lower stretches of the lower and upper belts. The lower press plate is fixed. The upper plate is vertically movable by means of a double-acting hydraulic actuator system.

Normally a plurality-of hydraulic cylinders (see U.S. Pat. No. 3,545,370) are provided on each frame bearing downward on the upper plate. Some movement of the upper plate, which may be formed of a single steel plate or of several joined-together plates, is possible since as the incoming mat is compressed and heated it resists compression differently. Thus it is known to provide the press with a sensor system for determining the press gap. Such sensors generate outputs that can be used to shut down the system when, for example, there is an interruption of the incoming workpiece so that the press bands could be pushed directly against each other, which would damage them.

In a known press described in commonly owned U.S. Pat. No. 5,112,431 of Gerhardt the press gap is set with a system of wedges They serve both to set the distance as well as to prevent excessive bending of the upper press plate. In this latter safety function they define the minimum gap that the press can have. It is also known from German patent 2,451,894 to use hydraulic cylinders having built-in stops which can be set up as wedges or just installed right into the cylinders. Such an arrangement limits the flexibility of the press with respect to the various working conditions it must meet, in particular the different workpieces the press must deal with.

OBJECTS OF THE INVENTION

It is therefore an object of the present invention to provide an improved continuous plate press.

Another object is the provision of such an improved continuous plate press which overcomes the above-given disadvantages, that is which can readily be adapted to different working conditions and which is set up to avoid the problems caused when the upper platen bends excessively.

SUMMARY OF THE INVENTION

A press for making pressed board has according to the invention a plurality of longitudinally spaced rigid frames, a lower press plate extending longitudinally through and secured to the frames, and a normally planar upper press plate extending longitudinally above the lower plate through the frames and defining with the lower press plate a longitudinally throughgoing press gap. The press plates are heated. A plurality of vertically effective double-acting hydraulic cylinders carried on the frames above the upper plate each have a back compartment and a front compartment, are connected to the upper plate, and support the upper plate on the frames. Respective upper and lower endless belts have respective lower and upper stretches extending through the gap immediately below and above the respective upper and lower plates and respective upper and lower rollers advance the stretches longitudinally through the frames. Sensors produce an output corresponding to the size of the gap. A safety unit connected to the upper plate produces an output when the upper plate is deformed to a predetermined extent from a planar shape. A hydraulic valve system connected to the compartments of the double-acting cylinders pressurizes and depressurizes same. A controller connected to the safety unit and valve system hydraulically blocks the cylinders when the safety unit generates its output and thereby stops downward movement of the upper plate. The safety unit can just hydraulically disconnect the cylinders to prevent damage to the press.

Thus the system of this invention eliminates actual mechanical stops. Instead when the upper plate is being deformed excessively, movement is blocked hydraulically.. This makes the system much more flexible and adaptable to different working conditions.

The safety function is realized simply when the sensors are connected to the controller and same hydraulically blocks the upper plate when the size of the gap between the platens is less than a predetermined minimum. Thus one need merely establish the desired board thickness as a set point and compare the actual value produced by the sensors. When the sensors detect that the press gap is less than the desired one, the press is immediately hydraulically blocked by fast-acting valves.

Since the upper plate can normally flex somewhat, the safety unit includes a rigid frame resting loosely on the upper plate and having a plurality of depending arms and respective position sensors fixed on the Upper plate adjacent the arms and generating outputs corresponding to the relative positions of the arms and position sensors. In addition the safety unit can incorporate a fluid-operated sensor in the upper plate generating an output indicating the levelness of the upper plate. The lower plate can have such a fluid-operated sensor also. The sensors can be on both longitudinal sides of the press;. They can be directly connected to the valve means.

The hydraulic valve system of this invention can include a main high-pressure line from a pressure source connectable to the hydraulic cylinders, another counter high-pressure line connected to the same pressure source as the main line, a valve between the lines that closes when pressure in the main line decreases suddenly, a pressure-drop valve in the main line connected to the safety means, and a low-pressure line connected to the valves.

According to the invention each frame is provided with three such hydraulic cylinders arranged in a transverse row and including a center cylinder and two outer cylinders flanking the respective center cylinder. In addition the cylinders of each frame have their own such hydraulic valve means.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
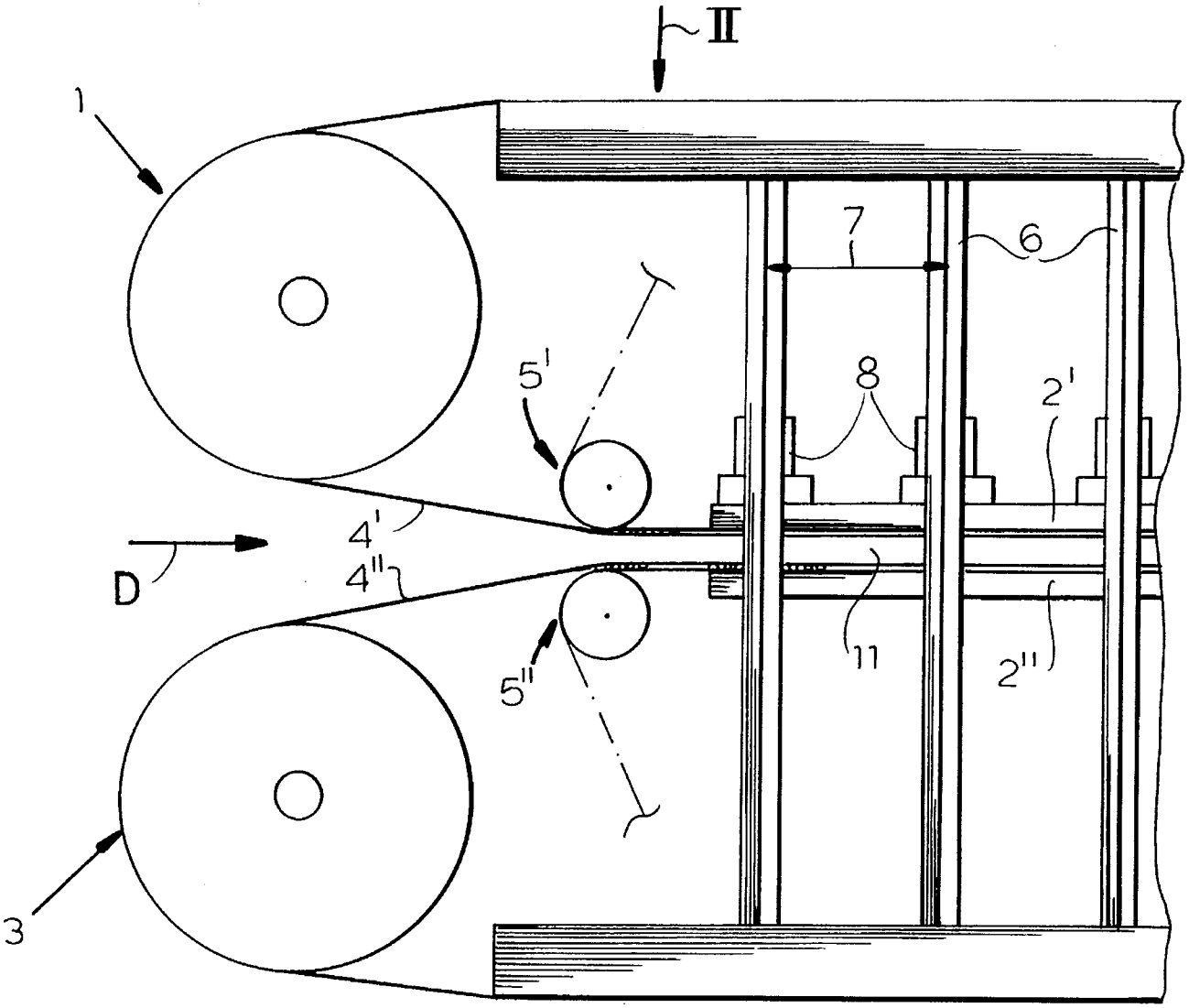
FIG. 1 is a partly diagrammatic side view of a portion of a press according to the invention.
Figure 2:
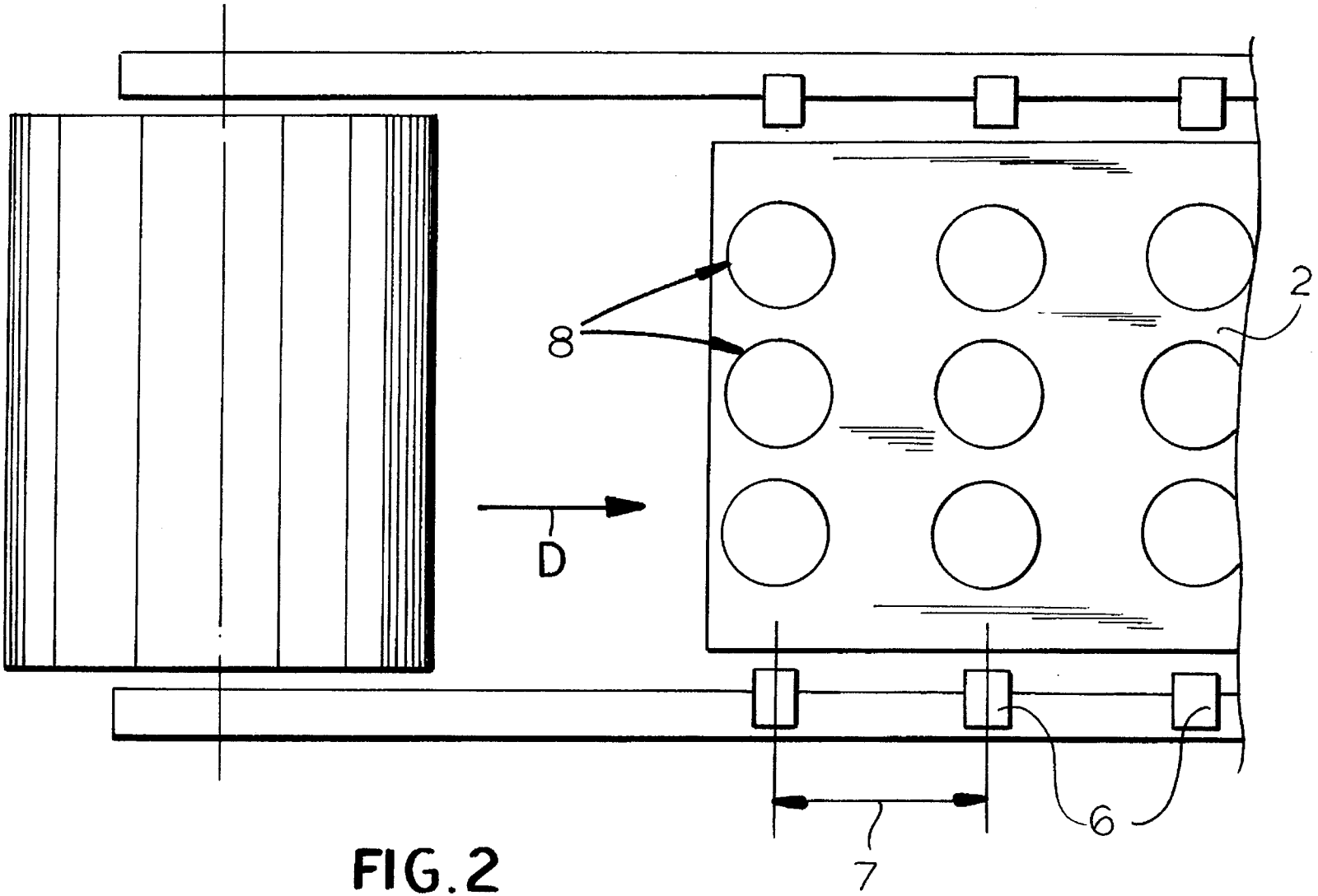
FIG. 2 is a top view taken in the direction of arrow II of FIG. 1.

As seen in FIGS. 1 and 2 the press according to this invention has an upper press part 1 having a heated upper platen 2' and a lower press part 3 having a heated lower platen 2". Respective upper and lower flexible steel belts 4' and 4" spanned over driven roller systems 5' and 5" pass between the platens 2 and 2" in a direction D to form a horizontally throughgoing gap 11. The press has a longitudinal succession of individual rigid frames 6 separated by a longitudinal spacing 7. The lower platen 2" is fixed to the frames 6 and the upper press platen 2' is supported via respective groups of actuators 8 on the frames 6. Each frame 6 has three such actuators 8, here double-acting differential-area hydraulic cylinders, equispaced in a transverse row.

Figure 3:
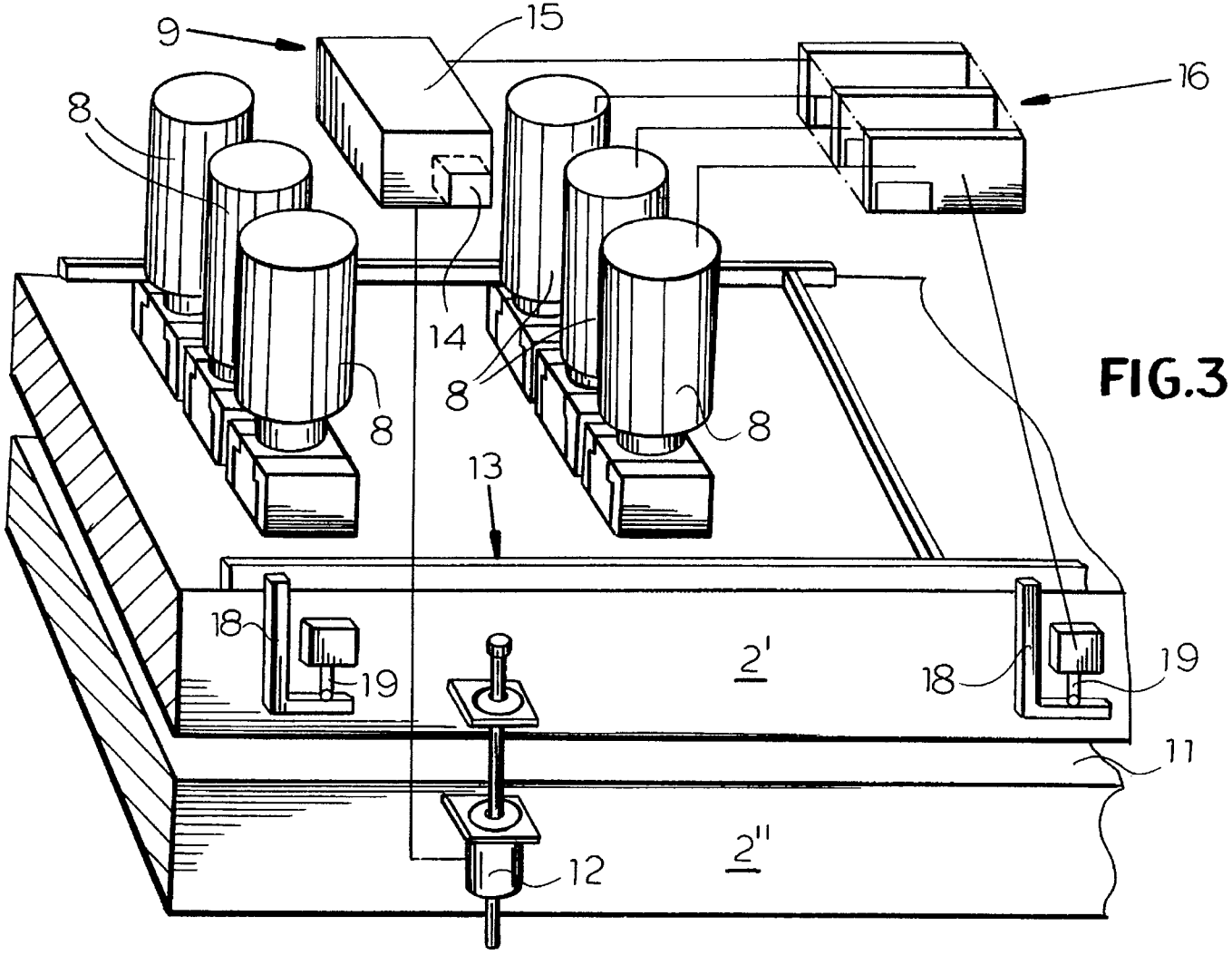
FIG. 3 is a partly sectional and diagrammatic perspective view of a portion of the press.
Figure 6:
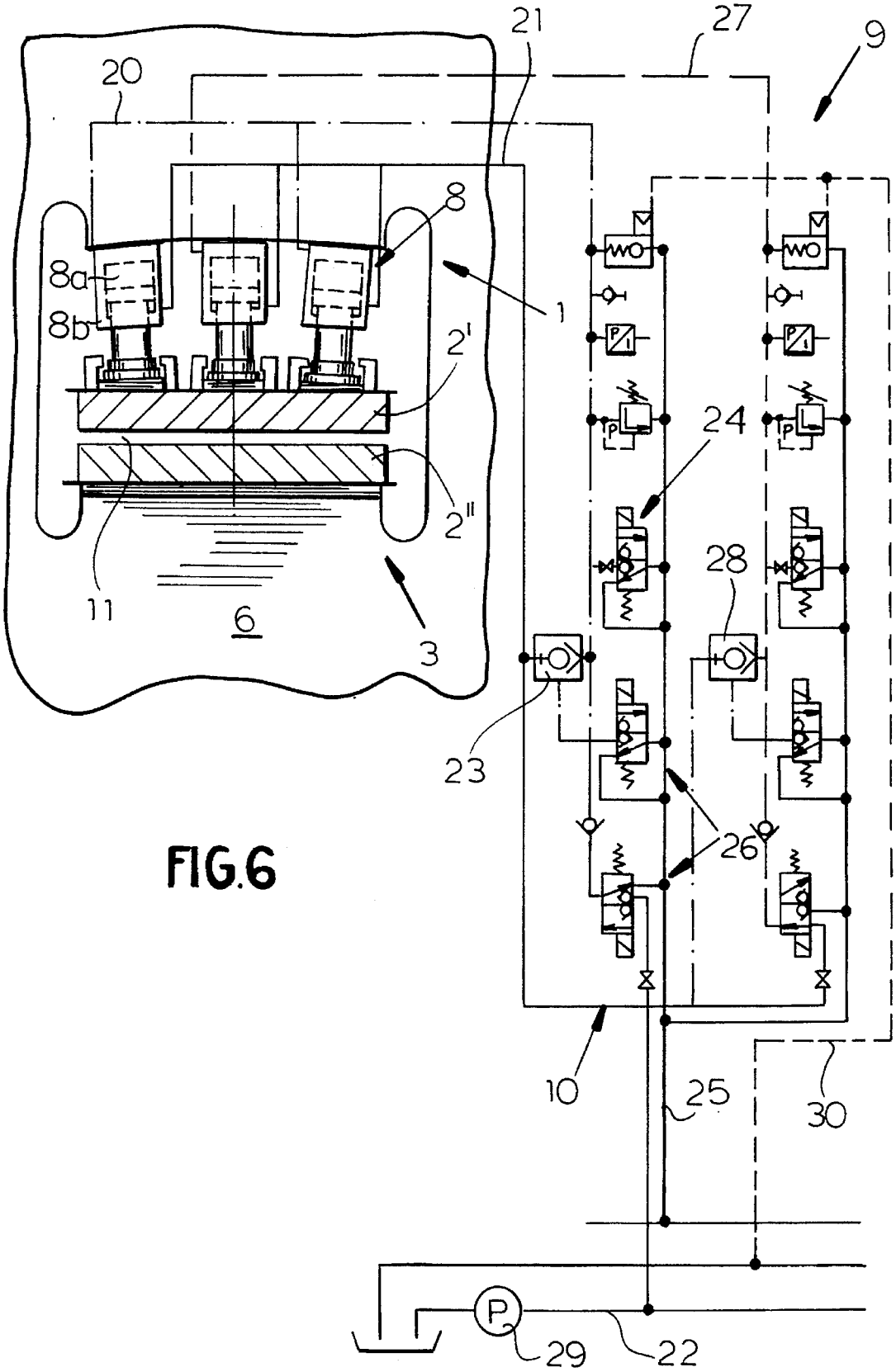
FIG. 6 is a schematic diagram illustrating the hydraulic control system of the press.

As also shown in FIG. 3, the actuators 8 are operated by a controller 9 via a hydraulic valve system 10 (see FIG. 6). Sensors 12 constituted, for example, as linear potentiometers are connected between the upper and lower plates 2' and 2" to provide an output to the controller 9 indicative of the vertical width of the gap 11. In addition a bend detector 13 is provided on the upper plate 2' to sense whether the upper plate 2' is bent from a nonplanar shape and to generate an output when it does so. In FIG. 3 this detector 13 is comprised of a rigid frame sitting loosely atop the plate 2' and extending virtually the full length thereof. Depending arms 18 from this frame 13 are juxtaposed with respective position sensors 19 that generate outputs when the plate 2' is excessively deformed.

Figure 4:
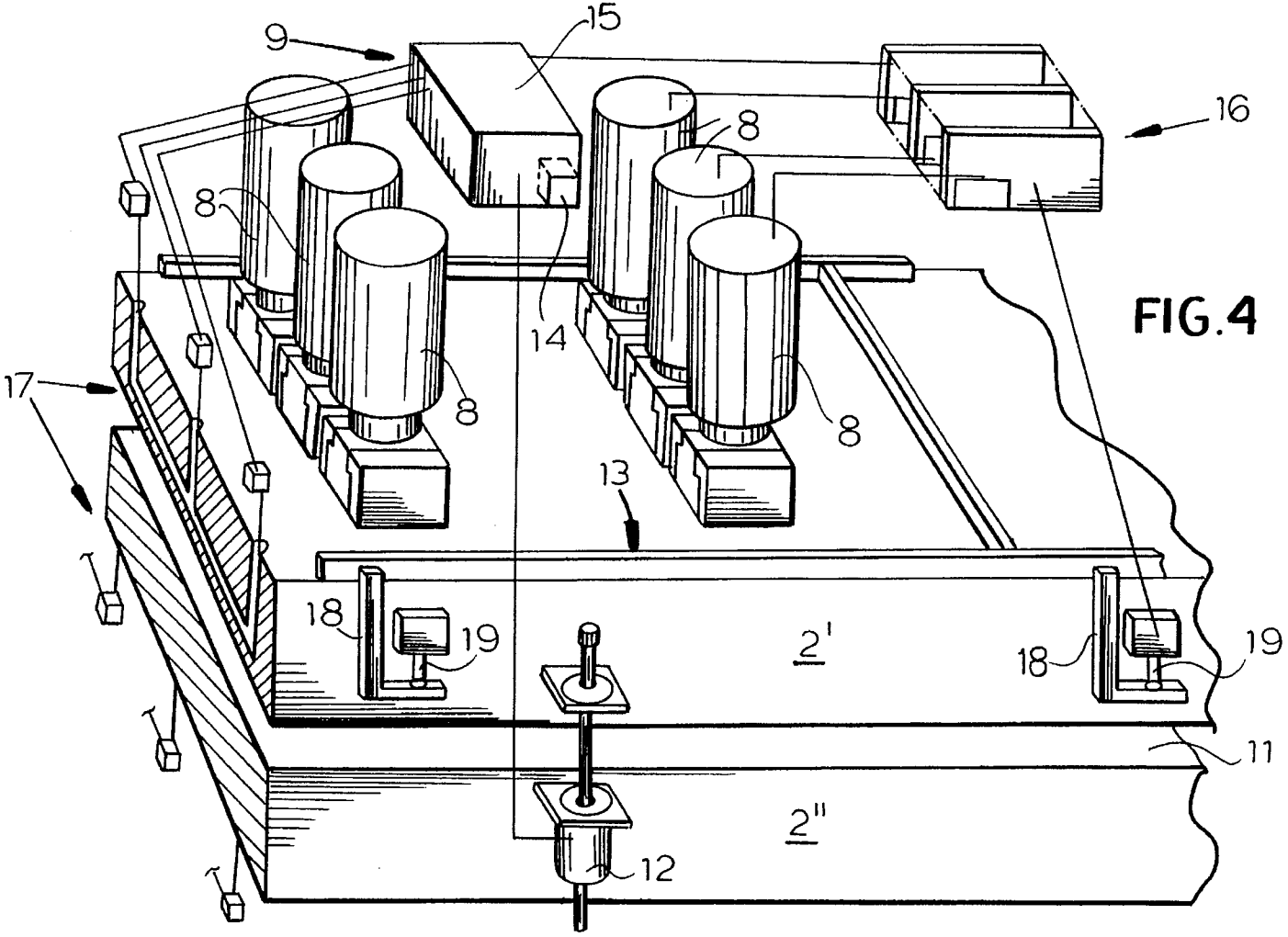
FIGS. 4 and 5 are views like FIG. 3 of variants on the press.
Figure 5:
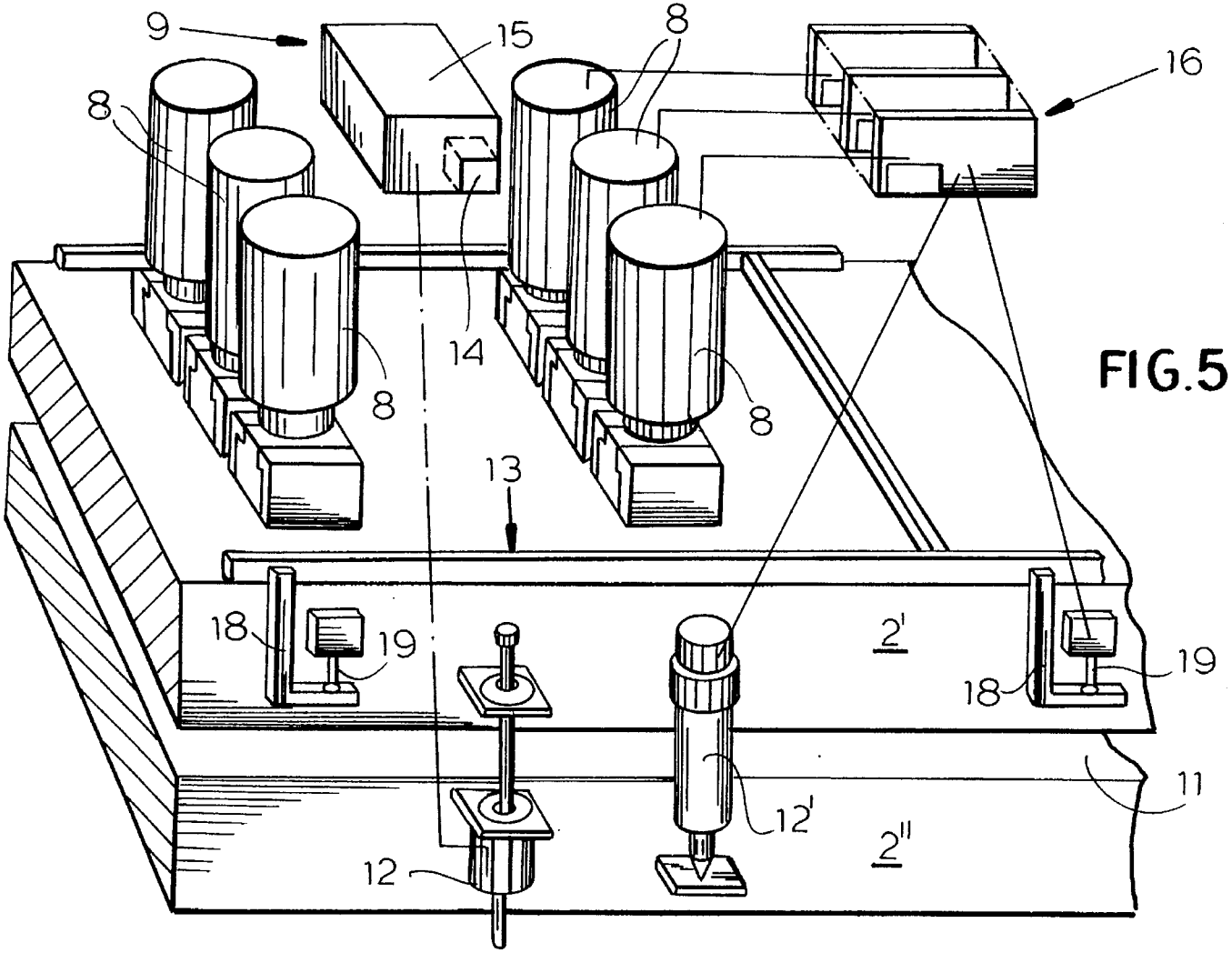

The controller 9 has a control unit 15 provided with a computer or microprocessor 14 and is connected to a valve controller 16. The output of the gap sensor 12 is fed to the unit 15 and the outputs of the position detectors 19 to the controller 16. It is also possible as shown in FIG. 4 to provide a fluid-type level-detector system 17 connected to the unit 15 in both the upper and lower plates 2' and 2" for generating outputs when the respective transversely spaced plate portions get out of level. In FIG. 5 spacing-detectors 12' are provided that are connected directly to the hydraulic system 10.

FIG. 6 shows the hydraulic system 10. It has a high-pressure working line 20 hooked to a high-pressure source 22 in turn connected to the output side of a pump 29 and a low-pressure sump line 30 connected to the input of this pump 29. The high-pressure line 20 serves for pressurizing back or main compartments **8*a* of the cylinders 8 and a high-pressure counterpressure line 21 connected to the same high-pressure source as the working line 20 serves for pressurizing front or blocking compartments 8*b* of the cylinders 8. The area of the pistons in the front compartments 8*b* are smaller than the respective areas in the back compartments 8*a***.

The system 10 further has a valve 23 between the lines 20 and 21 that closes when pressure drops in the line 20. There is at least one pressure-drop valve 24 in the high-pressure working line 20 which is connected to the safety means, here the bend detectors 13. In addition the low-pressure control line 25 is connected to valves 26 of the system 10. The line 20 is connected to the back compartments **8*a* of the outer two of each row of three actuators 8 and the back compartment 8*a* of the central actuator 8 is connected to a line 27 pressurized via a valve 28 comparable to the valve 23. All the lines 20, 21, and 27 are connectable to the same high-pressure source 22. Here the cylinders 8 of each frame 6 have their own systems 10 that are all connected to the source 22**.

We claim:

1. A press for making pressed board, the press comprising:

a plurality of longitudinally spaced rigid frames;

a lower press plate extending longitudinally through and secured to the frames;

a normally planar upper press plate ,extending longitudinally above the lower plate through the frames and defining with the lower press plate a longitudinally throughgoing press gap;

a plurality of vertically effective double-acting hydraulic cylinders carried on the frames above the upper plate, each having a back compartment and a front compartment, connected to the upper plate, and supporting the upper plate on the frames;

respective upper and lower endless belts having respective lower and upper stretches-extending through the gap immediately below and above the respective upper and lower plates;

respective upper and lower roller means for advancing the stretches longitudinally through the frames;

sensor means for producing an output corresponding to the size of the gap;

safety means connected to the upper plate for producing an output when the upper plate is deformed to a predetermined extent from a planar shape;

hydraulic valve means connected to the compartments of the double-acting cylinders for pressurizing and depressurizing same; and control means connected to the safety and valve means for hydraulically blocking the cylinders and thereby stopping downward movement of the upper plate when the safety means generates its output.

2. The board press defined in claim 1 wherein the sensor means is connected to the control means and same hydraulically blocks the upper plate when the size of the gap between the platens is less than a predetermined minimum.

3. The board press defined in claim 1 wherein the safety means includes:

a rigid frame resting loosely on the upper plate and having a plurality of depending arms, and respective position sensors fixed on the upper plate adjacent the arms and generating outputs corresponding to the relative positions of the arms and position sensors.

4. The board press defined in claim 1 wherein the safety means includes a fluid-operated sensor in the upper plate generating an output indicating the levelness of the upper plate.

5. The board press defined in claim 1 wherein the sensor means includes sensors on both longitudinal sides of the press.

6. The board press defined in claim 1 wherein the sensor means is directly connected to the valve means.

7. The board press defined in claim 1 wherein the hydraulic valve means includes:

a main high-pressure line from a pressure source connectable to the hydraulic cylinders, another counter high-pressure line connected to the same pressure source as the main line, a valve between the lines that closes when pressure in the main line decreases suddenly, a pressure-drop valve in the main line connected to the safety means, and a low-pressure line connected to the valves.

8. The board press defined in claim 7 wherein each frame is provided with three such hydraulic cylinders arranged in a transverse row and including a center cylinder and two outer cylinders flanking the respective center cylinder.

9. The board press defined in claim 8 wherein the outer cylinders are connected to the main high-pressure line and counter high-pressure line and the center cylinders are connected to the counter high-pressure line, the hydraulic valve means further including a secondary high-pressure line connectable to the center cylinders and a secondary pressure-comparing valve connected to the secondary high-pressure line, the main and secondary high-pressure lines and counter high-pressure line being connected to the pressure source.

10. The board press defined in claim 1 wherein the cylinders of each frame have their own such hydraulic valve means.

* * * * *